United States Patent [19]

Sergio

[11] Patent Number: 4,972,856

[45] Date of Patent: Nov. 27, 1990

[54] CIGARETTE FILTER SUITABLE FOR BEING FITTED IN A CIGARETTE

[76] Inventor: Nazzaro Sergio, Corso Vittorio Emanuele No. 24, Napoli, Italy

[21] Appl. No.: 853,334

[22] Filed: Apr. 16, 1986

[51] Int. Cl.[5] ..... A24D 3/04

[52] U.S. Cl. ..... 131/363; 131/339; 131/227; 131/229; 131/361

[58] Field of Search ..... 131/331, 361, 339, 363, 131/201

[56] References Cited

U.S. PATENT DOCUMENTS 1,616,851 2/1927 Geisler ..... 131/331

FOREIGN PATENT DOCUMENTS 0578509 9/1924 France ..... 131/188
40434 9/1987 Italy .
0002809 of 1911 United Kingdom ..... 131/188

*Primary Examiner*—V. Millin
*Attorney, Agent, or Firm*—Michael J. Striker

[57] ABSTRACT

A filter applicable to a cigarette and fitted therein by a user includes an elongated part fitted in a mouth provided in a cigarette and a flange which seals the cigarette mouth when the elongated part is inserted thereinto.

2 Claims, 1 Drawing Sheet

CIGARETTE FILTER SUITABLE FOR BEING FITTED IN A CIGARETTE

BACKGROUND OF THE INVENTION

Filters for cigarettes which are directly applied to the tip of a cigarette when it is made have been known. Such filters are used by the smoker when he smokes but always applies them externally to a cigarette.

SUMMARY OF THE INVENTION

It is an object the aim of this patent for an industrial use a new kind of a filter suitable for being fitted in the cigarette by the smoker.

It is a further object of the invention to provide a filter with right dimensions and of such a form that it would be fitted in any cigarette.

In the enclosed table there is carring out of this idea as a showing without bonds or restraints.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
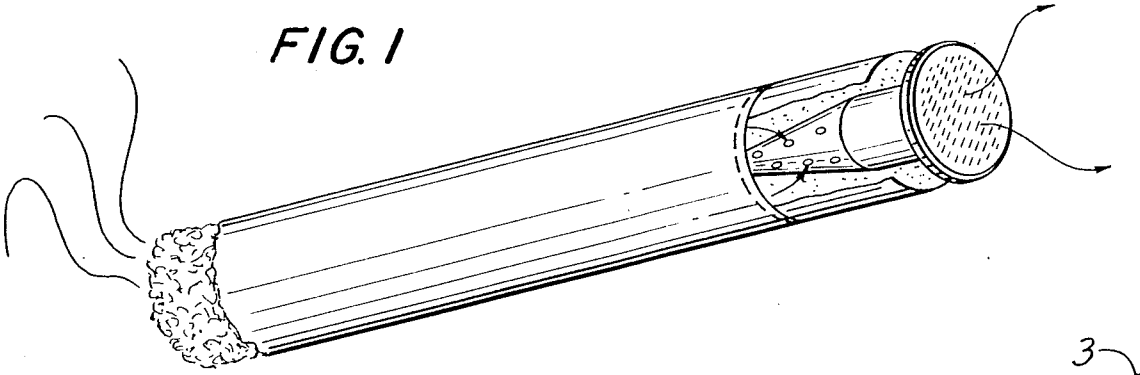
FIG. 1 is a perspective view of a cigarette with a filter according to the invention.
Figure 2:
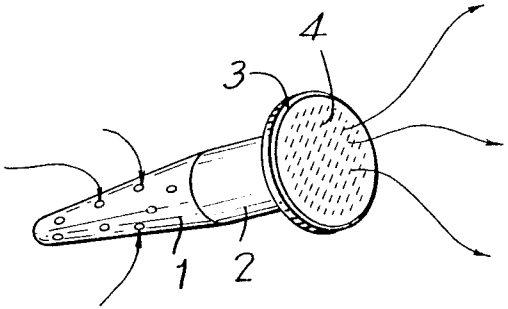
FIG. 2 is a perspective view of the filter of the invention.

The filter shown in the drawings has a bottom, which, is shaped as a frustum of cone-and a top part 2 which is cylindrical.

The part (1) is provided with a series of holes roundly placed, while the part (2) is provided with the edge or flange portion 3 which has holes 4 on its surface.

It is clear that the filter can be placed, at the end of the cigarette, or in the very filter of a filter cigarette, or linked with any non-filtered cigarette.

The part (1) is pushed into the mouth of the cigarette; the part (2), also pushed into the cigarette, leaves, in the cigarette edge, a part thereof which is just a little greater then the diameter of the cigarette, so as to create a perfect sealing of the cigarette mouth.

The filter according to the known invention has all the advantages of the filters, without, however having the disadvantage of an external filter which has nothing to do with the cigarette.

The filter can be provided within its interior with baffles or filtrating materials or with any other suitable filtrating system.

It possible to use the filtrating system which cannot be used with paper filters or with any other filter types utilized in industry.

The filter adjustment is extremely simple does not need expensive and cumbersome and unaesthetic cigarette holders containing filters; aesthetically the cigarette appears to have no filters.

The lack of any cigarette holder permits to avoid the touch of the smoker's teeth with it, which has proved to be very harmful.

The filter can be pulled out, if a smoker wants in order to be fitted in a new cigarette.

Furthermore, in a possible modification the shape of the bottom the filter can be changed. This bottom can be shaped as a frustum of a pyramid or as a rigid spring provided with holes along its length.

Such holes in the filter can be replaced by slits or openings of any form.

It will be understood that each of the elements described above, or two or more together, may also find a useful application in other types of cigarette filters differing from the types described above.

While the invention has been illustrated and described as embodied in a cigarette filter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A filter in combination with a cigarette having a pre-formed hole for receiving the filter, said filter being applicable to a cigarette by a user, said filter including an elongated part insertable into the cigarette and having a diameter fittable in said pre-formed hole, and a flange having a diameter slightly greater than that of the cigarette and extended outwardly from the cigarette when the filter is inserted into the cigarette, said elongated part including a conical portion and a cylindrical portion connected to said flange so that when said elongated part is pushed by a user into the cigarette said flange seals said opening, said flange extending outward from said cylindrical portion so as to have a thickness less than a length of said cylindrical portion and less than a length of said conical portion, said elongated part having an interior, said conical portion and said flange each having a plurality of holes in direct communication with said interior, said cylindrical portion having an outer surface entirely free of holes.

2. A filter in combination with a cigarette, said filter being applicable to a cigarette by a user, said filter including an elongated part insertable into the cigarette, and a flange having a diameter slightly greater than that of the cigarette and extended outwardly from the cigarette when the filter is inserted into the cigarette, said elongated part including a conical portion and a cylindrical portion connected to said flange so that when said elongated part is pushed by a user into the cigarette said flange seals the cigarette, said flange extending outward from said cylindrical portion so as to have a thickness less than a length of said cylindrical portion and less than a length of said conical portion, said elongated part having an interior, said conical portion and said flange each having a plurality of holes in direct communication with said interior, said cylindrical portion having an outer surface entirely free of holes.

* * * * *